US007644669B2

(12) United States Patent
Cross

(10) Patent No.: US 7,644,669 B2
(45) Date of Patent: Jan. 12, 2010

(54) COAL FIRED PROCESS HEATERS

(76) Inventor: Alan Cross, 73-34 244th St., Little Neck, NY (US) 11362

( * ) Notice: Subject to any disclaimer, the term of this patent is extended or adjusted under 35 U.S.C. 154(b) by 240 days.

(21) Appl. No.: 11/799,600

(22) Filed: May 3, 2007

(65) Prior Publication Data

US 2008/0271657 A1 Nov. 6, 2008

(51) Int. Cl.

| | |
|---|---|
| ***F23C 1/10*** | (2006.01) |
| ***F23C 1/12*** | (2006.01) |
| ***F24H 1/00*** | (2006.01) |
| ***F23B 99/00*** | (2006.01) |
| *D06G 1/00* | (2006.01) |
| *F23J 3/02* | (2006.01) |

(52) U.S. Cl. ..... 110/261; 122/16.1; 122/235.22

(58) Field of Classification Search ..... 110/269, 110/270, 263, 347; 122/235.23, 16.1, 235.22, 122/44.1, 235.14, 392; 15/316.1

See application file for complete search history.

(56) References Cited

U.S. PATENT DOCUMENTS

| | | | | | |
|---|---|---|---|---|---|
| 1,790,750 | A | * | 2/1931 | Jacobus | 122/235.11 |
| 2,363,875 | A | * | 11/1944 | Kreisinger et al. | 122/479.1 |
| 2,862,463 | A | * | 12/1958 | Duncan | 110/170 |
| 4,020,797 | A | * | 5/1977 | Hug | 122/2 |
| 4,522,154 | A | * | 6/1985 | Taylor et al. | 122/4 D |
| 4,960,058 | A | * | 10/1990 | Materna | 110/336 |
| 5,018,456 | A | * | 5/1991 | Williams | 110/342 |
| 5,054,405 | A | * | 10/1991 | Walker | 110/254 |
| 5,555,821 | A | * | 9/1996 | Martinez | 110/191 |
| 6,352,040 | B1 | * | 3/2002 | Voorhees et al. | 110/237 |
| 6,521,021 | B1 | * | 2/2003 | Pennline et al. | 95/134 |
| 6,928,937 | B2 | * | 8/2005 | Booher | 110/348 |

* cited by examiner

*Primary Examiner*—Kenneth B Rinehart
*Assistant Examiner*—David J Laux

(57) ABSTRACT

An embodiment of the invention consists of a process heater with a radiant section and an overhead convection section, the radiant section having a vertical cylindrical, contiguous, helical, tubular coil, having a bottom process fluid inlet and top process fluid outlet. The process fluid coil is contained in a refractory lined enclosure of square cross section and is exposed to an up flowing stream of combustion products, generated by burning coal on a continuous, traveling, chain grate stoker. The stoker is located at the base of the radiant section, receives a continuous deposit of coarse coal, with a minimum of fines, from a hopper located at one end of the stoker chain grate and discharges essentially coal free ash at the opposite end of the chain grate, thru a nozzle provided with a water seal. One or more centrifugal solids—gas separators are provided at the radiant section flue gas outlets for the purpose of removing ash particulates from the flue gas streams, before the latter enter the overhead convection section. Since the flue gas enters the convection section very nearly devoid of particulates, the convection section may be of conventional design, utilizing bare or extended surface tubes, on closely spaced equilateral or quadrilateral centers.

1 Claim, 4 Drawing Sheets

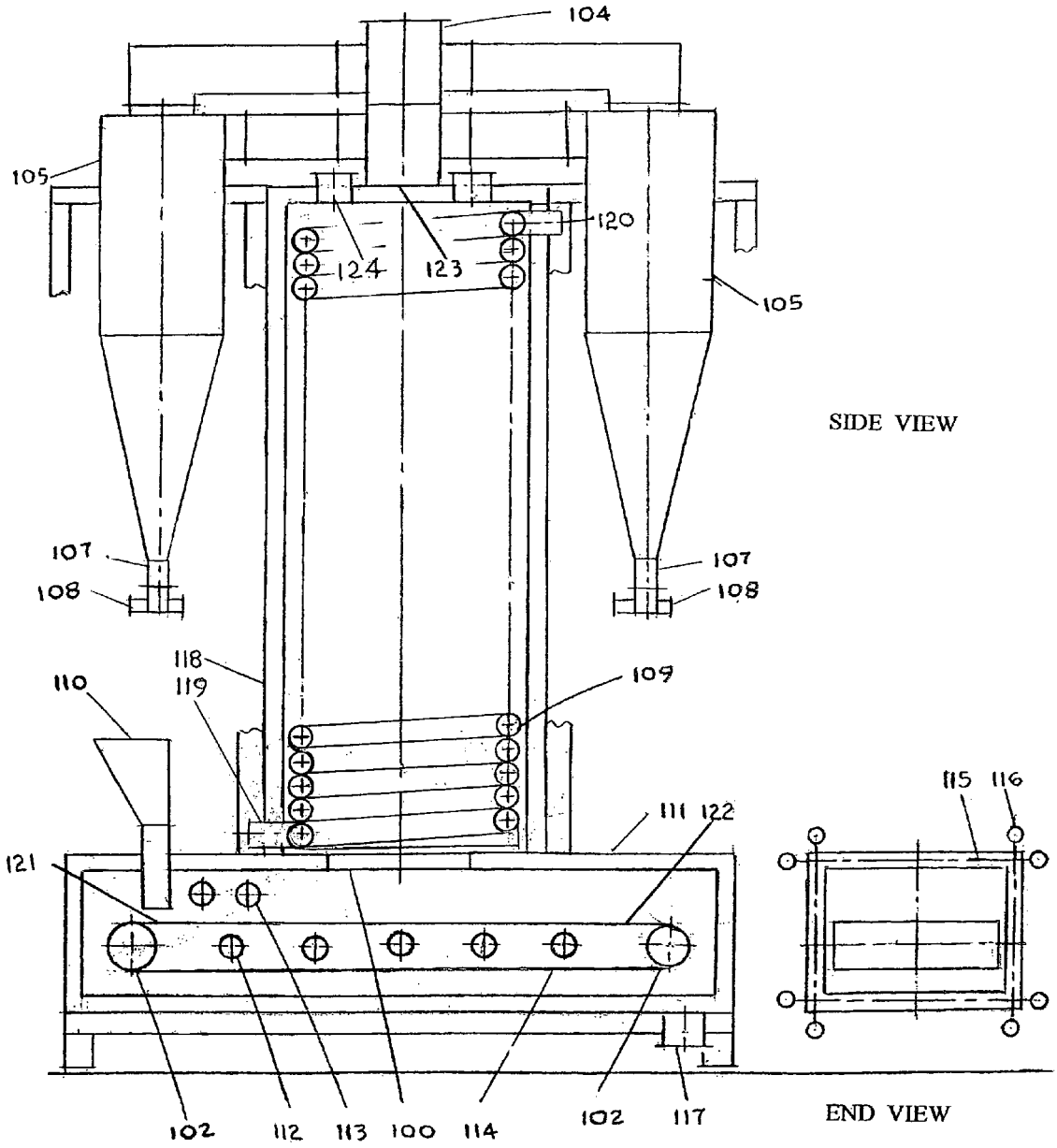
104
105
120
124
123
105
SIDE VIEW
107
108
107
108
118
119
110
109
115
116
111
122
121
102
112
113
100
114
102
117
END VIEW

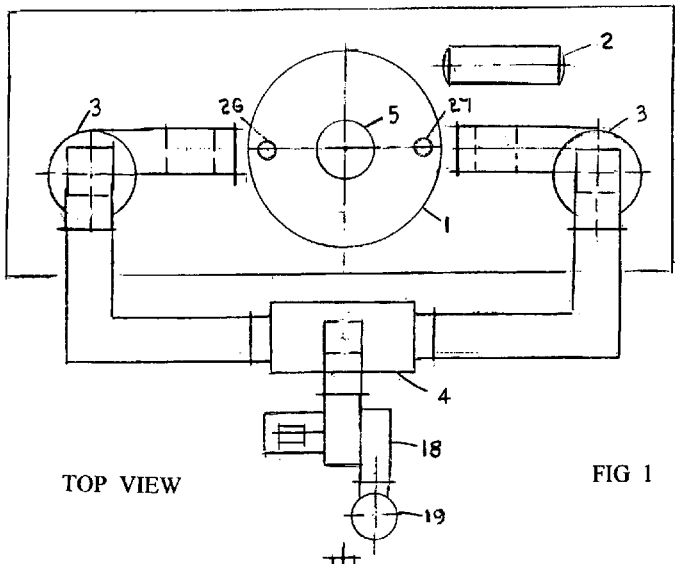
TOP VIEW
FIG 1
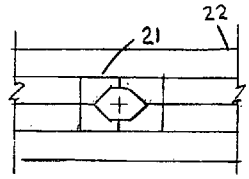
FIG 2
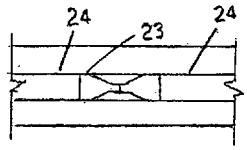
FIG 3
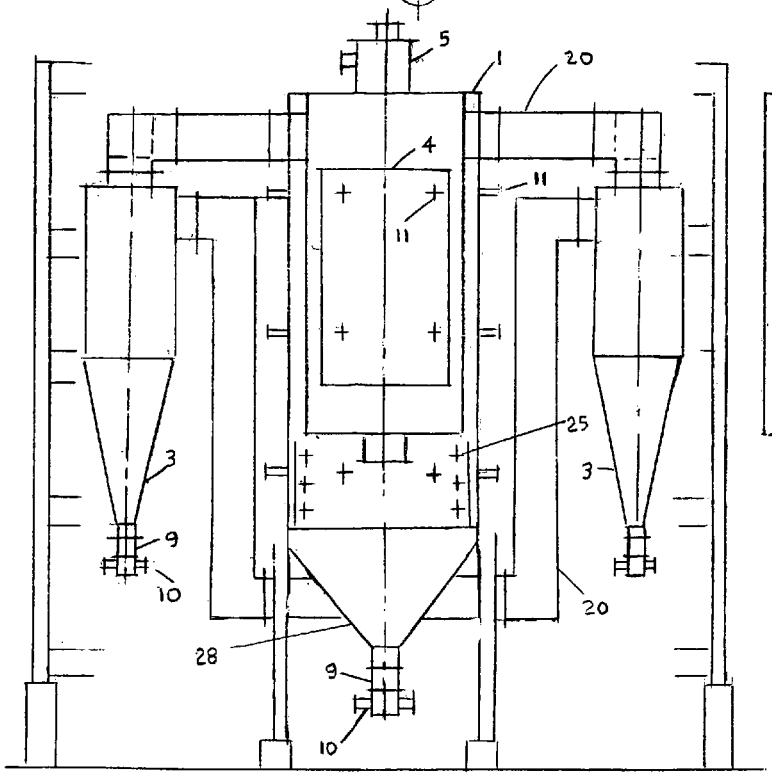
SIDE VIEW
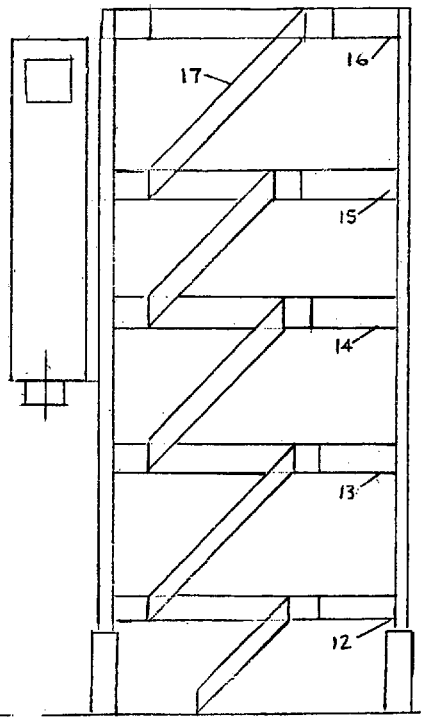

TOP VIEW

SIDE VIEW

END VIEW

COAL FIRED PROCESS HEATERS

BACKGROUND OF THE INVENTION

Conventional process heaters find wide usage in oil refineries and chemical plants and are usually fired by oil or gas. Such heaters usually consist of a refractory lined combustion chamber, fired by one or more burners, and are provided with tubular heating elements disposed within the combustion chamber. These elements consist of serpentine coils composed of vertical or horizontal tubes, spaced two or three tube diameters apart, with empty spaces in between, these allowing the back up refractory to be exposed to hot flue gas. In some instances the coils are fired from both sides, but invariably refractory surfaces exposed to hot flue gas are present. As a result, conventional heaters designed for gas or oil firing, when fired by pulverized coal, do not operate satisfactorily, because the refractories in some instances operate at temperatures above the ash fusion point, allowing molten ash particulates generated by the burning coal to rapidly accumulate on such surfaces, causing heater inoperability and forced shutdown. Impingement of molten ash on cold surfaces also poses operability and tube corrosion problems that need be considered when firing coal.

This invention seeks to overcome these problems by very nearly eliminating refractory surfaces exposed to hot flue gas and allowing cold surfaces only to be so exposed. Furthermore, provision is made to remove solidified ash particulates from cold surfaces by appropriate soot blowing equipment, while minimizing tube corrosion problems by judicious choice of construction materials. Particulate laden flue gas leaving the combustion chamber at relatively low temperature is also rendered essentially particulate free using centrifugal gas—solid separators, thereby allowing for convection preheating, using conventional bare or finned tubing, serviced by conventional soot blowing equipment, and minimizing excessive fouling that could lead to inoperability and shutdown.

SUMMARY OF THE INVENTION

This invention relates to the design of coal fired process heaters. These heaters consist of a radiant section, a convection section, a radiant section process coil, a convection section process or heat conservation coil, one or more burners, one or more centrifugal gas—solids separators, a water—steam cooled solids containment hopper, a solids removal system, and radiant and convection coil steam jet rotary soot blowers. The radiant section is provided with a contiguous helical tubular coil or a contiguous vertical tube serpentine coil, which shields the refractory from hot flue gas and molten ash particulates that could otherwise cause excessive fouling and heater inoperability. In the case of FIG. 1, one or more burners, firing down words and in the case of FIG. 4 horizontally, are designed such that combustion occurs only after the premixed air-fuel mixture leaves the burner. Burners are sized so that the fuel-air mixture exiting the burner does so at a velocity of 125 feet per second. Thru use of a firebox height to width ratio of 2.8, the width being measured diametrically between helical coil centerlines as in the case of FIGS. 1 and 6, or the center line distance between tubes at the wall, in the case of FIG. 4, there is assurance that there will be but little contact between the diverging flue gas jets and tubes at the wall of the enclosure except at the flue gas heater outlet at the top or bottom of the heater radiant section. In the case of FIG. 6, an orifice is provided at the radiant section flue gas inlet of the vertically oriented helical coil heater, located immediately above the outlet of the traveling grate stoker. This orifice is sized to provide for a hot flue gas velocity of 250 feet per second. As in the case of FIG. 1, there should be but slight interaction between the hot flue gas jet and the tubes at the wall of the heater, except at the heater outlet. Tubes of which the heating surfaces are comprised are of Incoloy Alloy 800H, a high chrome nickel alloy, which is considered adequately resistant to corrosion by molten fly ash, particularly since the arrangement of the heating surface—burner arrangements in the designs proposed are such as to limit interaction between burner generated fly ash and heat transfer surfaces. Corrosion is also minimized due to the low operating temperature of tube wall surfaces relative to the fusion temperature of the ash.

Gas—solids centrifugal separators are provided to accept flue gases, laden with solidified ash particulates from the radiant section outlet, and discharge the gases, very nearly devoid of particulates, to the convection section. The cleanliness of flue gas entering the convection section which results, permits the use of conventional convection section heating surfaces such as bare and/or finned tubes on closely spaced triangular or quadrilateral centers. Efficient operation of the radiant and convection heating surfaces is also maintained thru use of rotary soot blowers, which use high pressure steam as a blowing medium. Ash solids removed from the tubes by soot blower action are captured by a water—steam cooled ash containment hopper which conveys the ash solids to an outlet system consisting of rotary valves and pneumatic conveying nozzles. In those instances where movement of ash from the hopper outlet to one or more remote outlet nozzles is necessary, use is made of screw conveyors upstream of the rotary valves and pneumatic conveying nozzles. A steam drum is provided to separate steam and hopper coolant and allow for movement of coolant thru the hopper by means of natural or forced circulation.

BRIEF DESCRIPTION OF THE DRAWINGS

FIG. 1 depicts a vertical cylindrical contiguous helical coil process heater with top, down fired, pulverized coal burner. Shown are a top view and side view of a vertical longitudinal section taken thru the vertical centerline of the heater.

FIG. 2 depicts soot blower and inspection door openings formed of contiguous helical coil tubes connected to four eccentric welding reducer fittings, as shown by a view at right angles to the plane of the coil.

FIG. 3 depicts a fabrication or field welded joint between two contiguous helical coil sections. The joint consists of two tubes, the ends of which are connected to two concentric welding reducer fittings, as shown by a view at right angles to the plane of the coil.

DETAILED DESCRIPTION OF THE INVENTION

Figure 4:
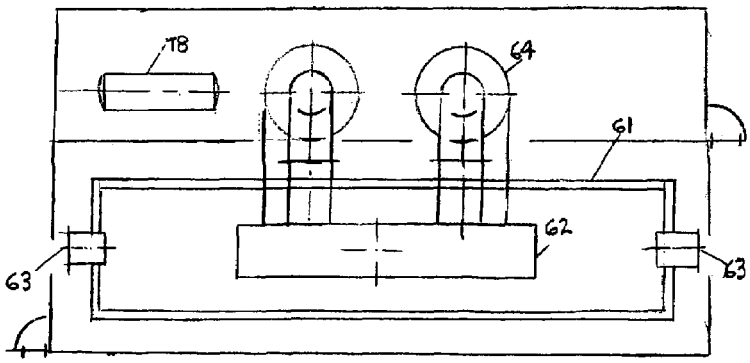
FIG. 4 depicts a cabin type process heater with contiguous vertical tube serpentine coil and bottom, horizontally fired pulverized coal end wall burners. Shown are a top side view and a side view of a longitudinal section thru the vertical center line of the heater.

One embodiment of the proposed invention is as shown in FIG. 1 and consists of a vertical cylindrical radiant section, 1, the vertical steel shell of which is lined with refractory. A contiguous, down flow, bottom supported tubular helical coil, 25, is located concentrically with respect to the refractory lining, and steel shell, the lining providing back up insulation for the tubular coil. Process fluid, the fluid which is to be heated, enters the top of the process coil at nozzle 26, flows downward and exits the bottom of the process coil at nozzle 27. The process coil is contiguous, meaning that there is no space between adjacent tubes, so that contact with and fouling of refractory by molten ash is avoided. By using a down flow process coil arrangement, the process inlet is located where flue gas temperatures are highest, that is close to the burner outlet, and the process coil outlet is located where flue gas temperatures are lowest, that is at a point most remote from the burner outlet. In so doing, tube metal temperatures are minimized at a level not to exceed 1100 to 1200 F. At these levels, available data would indicate that Incoloy Alloy 800H would satisfactorily resist corrosion due to ash deposition.

By using a bottom process coil support system, formation of gaps between adjacent tubes is avoided because the weight of the upper tubes cause upper and lower tubes to remain in contact. By providing adequate clearance space above the coil and between coil and backup refractory, unrestricted thermal expansion of the coil can occur, thereby minimizing thermal stress in the coil.

A vertical down fired pulverized bituminous coal burner, 5, located at the top of the radiant section fires a mixture of minus 200 mesh coal and conveyance air. The air—coal mixture enters the burner thru the primary burner inlet nozzle, is ignited at the burner outlet, and leaves the burner at an outlet velocity of 125 feet per second or more. The coherent hot flue gas jet exiting the burner diverges at an angle of less than 20 degrees carrying with it burning coal and molten ash particles. The jet outside diameter does not intercept the tubes at the periphery of the coil until reaching beyond the outlet of the radiant section. Since the flue gas temperature at this location may be as low as 1400 to 1500 F, a temperature lower than the minimum ash fusion temperature of 1900 to 2200 F, the ash particles are no longer molten and incapable of fouling the centrifugal gas—solids separators or the convection refractory and tubing downstream of the separators.

The one or more centrifugal separators, 3, provided, separate ash particulates from the flue gas stream exiting the sidewalls of the hopper at the bottom of the radiant section and route flue gas flow, very nearly devoid of particulates, to the down flow convection section, 4. The convection section has a rectangular cross section and is provided with multiple rows of horizontal bare and/or finned tubes. Use of finned tubes is permissible due to the near absence of solid particulates in the flue gas stream exiting the centrifugal separators. An induced draft fan and stack, 18 and 19, are provided for flue gas movement thru and away from the heater.

A water—steam cooled conical ash solids hopper, 28, located at the bottom of the radiant section, is provided, the mouth of the hopper being located immediately below the lower end of the process coil. Ash solids from the tubes and in part from the flue gas—particulate jet, are collected and discharged thru the outlet ash removal components. Ash movement thru the hopper is by gravity, assisted by the rotary steam soot blowers. A steam—water cooling jacket, surrounding the ash hopper at the bottom of the radiant section serves the purpose of minimizing hopper overheating due to flue gas radiation, so as to avoid the possibility of fusion of ash particulates contained in the hopper. Without such cooling, fouling of the hopper walls could occur, as could interference with withdrawal of ash agglomerates via the hopper outlet system.

Rotary valves, 9, isolate the solids outlets from pressurized pneumatic nozzles, 10, at the centrifugal separator and ash hopper outlets.

A steam drum, 2, separates cooling water and steam, leaving the ash hopper cooling jacket at saturation temperature. Steam—water inlet and outlet nozzles, connected to the steam drum riser and down corner piping, permit movement of fluid thru the hopper cooling jacket by natural or forced circulation.

Strategically located rotary steam jet soot blowers, 11, using high pressure steam, remove stray ash particulates impinging on tubes in the radiant section. In those instances where the impinging ash particulates are still molten, the tube coil, at temperatures of 1100 to 1200 F, rapidly quench and solidify the molten particulates, and allow the latter to move towards the ash hopper outlet system, with the aid of soot blower action.

Soot blower and inspection port openings, 22, in contiguous heating coils are formed by four eccentric welding reducer fittings, 21, welded to the ends of each of four tubes. For tubes connected to reducers with a large end having an outside diameter one inch larger than the small end, the ports so formed, are about 2 inches in diameter.

Shop assembly or field welded joints, between two contiguous helical coil sections, or between two tubes, 24, is accomplished by joining the ends of the tubes to the large ends of two concentric welding reducer fittings, 23, and welding the small ends of the reducer together in shop or field. For reducer fittings having a large end outside diameter one inch larger than the outside diameter of the small end, the free area for welding access is approximately one half inch in diameter. This method of joining two tubes is rendered unnecessary, when tubes are small and flexible enough, to permit prying the tubes apart to obtain clearance space for welding.

A second embodiment of the proposed invention is as shown in FIG. 4, and consists of a steel shelled enclosure with rectangular side walls, end walls, and top and bottom closures, lined with refractory. A vertical contiguous top supported, bottom guided serpentine tubular coil, 65, is located concentrically with respect to the refractory lined end and side walls of the heater shell, the lining providing backup insulation for the tubular coil. Process fluid, the fluid to be heated, enters the process coils at nozzles, 66, and exits at nozzles 67. The process coil is contiguous so that contact with and fouling of refractory with ash is avoided. By using a serpentine coil arrangement, the process inlet may be located where flue gas temperatures are highest, that is, close to the burner outlets and process coil outlets may be located where flue gas temperatures are lowest, that is, remote from the burner outlets. In so doing, tube metal temperatures are minimized. By providing adequate clearance between process coils and refractory and by using a top supported, bottom guided coil support arrangement, unrestricted thermal expansion of the coil is obtainable, thereby allowing for minimization of thermal stress in the coil.

Horizontally fired pulverized bituminous coal burners, 63, are located at the end walls, at the bottom of the radiant section. A mixture of minus 200 mesh pulverized coal and conveyance air enters the burners thru the primary burner inlet nozzles, is ignited at the burner outlets and exits the burner at a velocity of 125 feet per second or higher.

Centrifugal gas-solids separators, 64, accept flue gas-solids out flow from the top of the radiant section, by way of refractory lined ducts, having inlets at the lower rectangular section of a flue gas collector, 62, and outlets at the solids-flue gas separators. Essentially solids free flue gas exits the separators, by way of refractory lined ducts with inlets at the top of the separators and outlets at the top section of the flue gas collector. Top and bottom sections of the collector are separated by a partition plate. The top of the collector, 79, routes flue gas to a refractory lined convection section, not shown, the convection section having a rectangular cross section and being provided with multiple rows of bare and/or finned tubes on closely spaced triangular or quadrilateral centers. Use of finned tubes is permissible due to the near absence of particulates in the centrifugal separator effluent.

A water-steam cooled bottom ash hopper, 76, is provided wherein ash solids removed from the heating surfaces, and in part from the hot flue gas burner jet, are collected and discharged thru the outlet ash removal components. Ash movement thru the hopper is by gravity, assisted by rotary soot blowers using high pressure steam.

A steam-water cooling jacket, 77, surrounding the ash hopper, at the bottom of radiant section is provided. Its purpose is to minimize hopper overheating caused by flue gas radiation from above and to prevent fusion of ash agglomerates contained in the hopper. Without such cooling, fouling of the hopper walls could occur as could interference with withdrawal of ash agglomerates via the ash removal components.

Screw conveyors, 68, at the bottom of the ash hopper, move ash particulates discharged from the hopper to outlets at the far end of each conveyor. Rotary valves, 70, and pneumatic conveying nozzles, 69, at the ash hopper and centrifugal separator solids outlets remove and transport ash to appropriate storage vessels prior to movement elsewhere. Steam jet sootblowers, 75, used for removal of stray ash particulates impinging on radiant section tube surfaces, are strategically located at the walls of the radiant section so as to remove ash deposits from those surfaces. A steam drum, 78, separates the steam-water mixture leaving the outlet of the hopper cooling jacket. Appropriate siring of interconnecting down-comer and riser piping between the cooling jacket and steam drum allow for natural or forced circulation of coolant.

Figure 5:
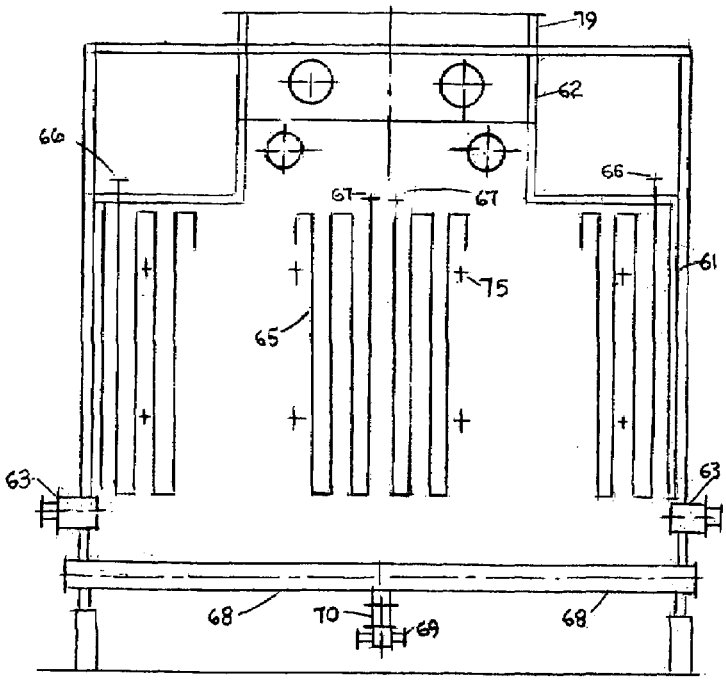
FIG. 5 is a side view of a contiguous vertical tube serpentine coil section consisting of straight tubes welded to the large ends of eccentric welding reducer fittings and 90 degree welding elbow fittings, the latter being welded at one end to the small ends of the reducer fittings. Assembly of the coil requires that the two 90 degree elbows on adjacent tubes be welded to one another so as to form a completed section of the coil.
Figure 5:
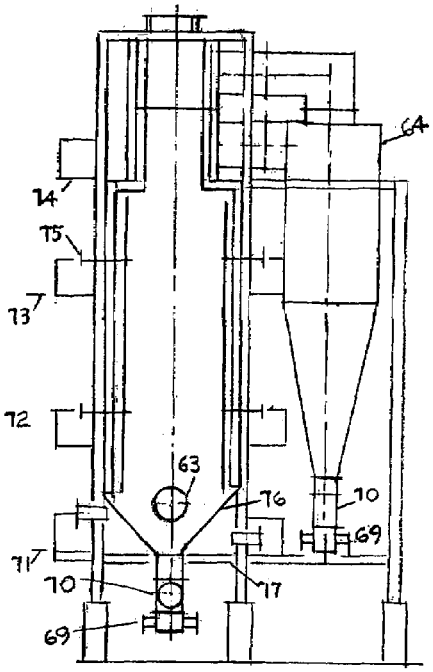
Figure 5:
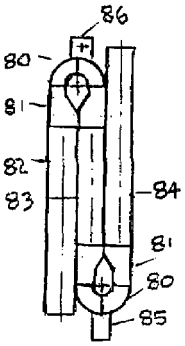

Contiguity of vertical tube serpentine radiant section coil, 65, show in FIG. 5, is achieved by connecting the large ends of concentric welding reducer fittings, 81, to each end of straight vertical tubes, 82, 83, and 84 and connecting small ends of the reducer fittings to 90 degree welding elbows, 80. To assemble a coil section, or an entire coil, a single straight tube connected at each end to a reducer fitting and one end of an elbow, is connected to an adjacent tube of like assemblage, and welding free elbow ends of the adjacent tubes together in serpentine fashion.

Figure 6:
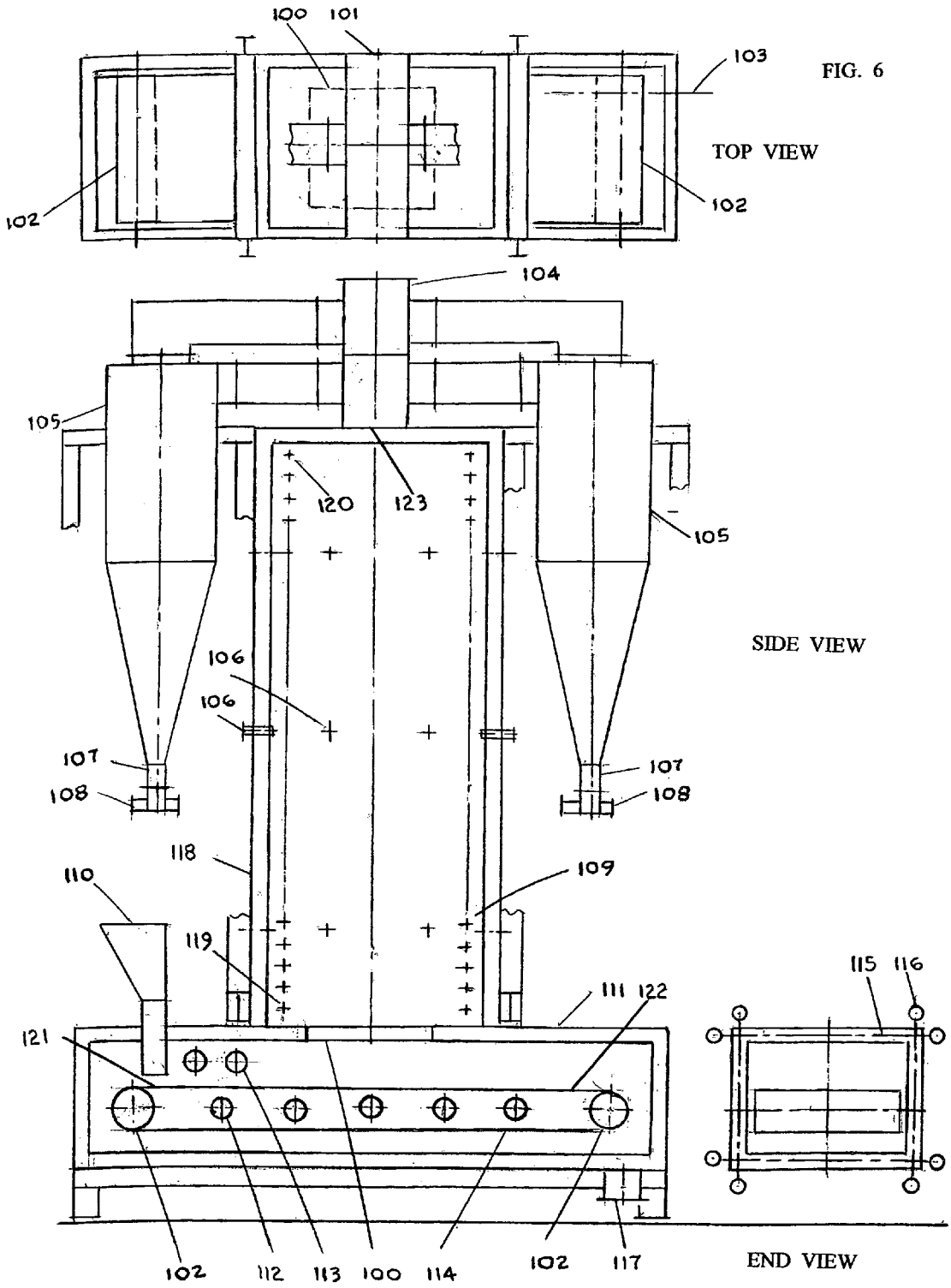
FIG. 6 depicts a vertical cylindrical, contiguous, helical coil process heater mated to a continuous chain grate coal stoker, which supplies process heat requirements by burning bituminous coal on a horizontal, flexible, traveling grate driven by a motorized sprocket at one end of the grate, and an idler sprocket at the opposite end of the grate. Shown are a top side view and center line end view of sections thru the vertical center line of the heater.

A third embodiment of the proposed invention is as shown in FIG. 6 and consists of a vertical cylindrical, helical coil radiant section, 118, the vertical shell of which is lined with refractory. A contiguous, up flow, bottom supported, tubular helical coil, 109, is concentrically located with respect to the refractory lining and steel shell, the lining providing back up insulation for the tubular coil. Process fluid, the fluid which is to be heated, enters the process coil at the lower most tube or tubes in the helix, 119, and leaves at the upper most tube or tubes in the helix, 120. The process coil is contiguous, so that contact with, and fouling of the refractories by molten or solidified ash particles cannot occur. By using an up flow process coil arrangement, the process fluid enters at the lower most tubes, 119, at a point where flue gas temperatures are highest and leave at the uppermost tubes, 120, at a point where flue gas temperatures are lowest As a result, overheating of tubes and process fluid is prevented. By using a bottom support system, formation of gaps between adjacent tubes is avoided, because the weight of the upper tubes cause upper and lower tubes to remain in contact. By providing adequate clearance above the coil and between the coil and refractory, unrestricted thermal expansion of the coil can occur, thereby minimizing thermal stress in the coil.

A continuous chain grate stoker, 111, driven by sprockets, 102, and located below the radiant section containing the helical coil, is provided. The orifice, 100, is sized to provide for a flue gas of 250 feet per second, and is located between the outlet of the stoker and the inlet of the radiant section. The hot coherent flue gas jet exiting the orifice diverges at an included angle of about 20 degrees, carrying with it burning coal and molten ash particulates. The jet outside diameter, however, does not intercept the tubes at the periphery of the coil, until reaching beyond the outlet of the radiant section, a location at which ash solidification has already taken place, so that tubes and solid—gas separator fouling is minimized. A vertical feed hopper, 110, at one end of the stoker deposits a continuous flow of coarse coal, having an average particle size of ½×⅜ inches and a minimum of minus 200 mesh coal fines, at the top of a moving grate, at one end of the grate, 121, and discharges essentially coal free ash at the opposite end of the grate, thru a water sealed nozzle, 117. Burners, 113, located above the coal level at the inlet end of the grate provide initial ignition of the feed coal and multiple ports, 112, located between the top of the grate, 114, and bottom of the grate, 122, and along the length of the grate, provide pressurized air for combustion of the coal. A multiplicity of water cooled tubes, 115, manifolded at inlets and outlets, 116, are imbedded in the refractory lining of the sidewalls, end walls, and top and bottom of the stoker enclosure. Transfer lines from the inlet and outlet manifolds connected to an overhead steam drum, as indicated by centerline, 103, separate the steam and water phases and allow for natural or forced circulation thru the stoker refractory cooling tubes.

Refractory lined centrifugal solids-flue gas separators, 105, provided with rotary valves, 107 and pneumatic transport nozzles, 108, accept solids laden flue gas from the lower section of the flue gas collector, 123, located at the top of the heater radiant section, using refractory lined ducts, the inlets of which penetrate the walls of the lower flue gas collector and the outlets of which attach to the separator inlets. The separator outlets connect to the inlets of a second set of refractory lined ducts which transport essentially solids free flue gas to the duct outlets which penetrate the upper section of the flue gas collector. The top of the collector, 104, discharges flue gas to an overhead up flow convection section, 101.

Strategically placed steam jet soot blowers, 106, using high pressure steam, penetrate the radiant and convection section walls so as to remove fouling deposits from the outside walls of the heating surfaces.

What is claimed is:

1. A coal fired process heater consisting of a vertical shell with square cross-section and a top closure plate lined with refractory; a contiguous up-flow, helical, bottom supported, tubular, cylindrical, process coil, having one or more parallel helices, located concentrically with respect to the refractory lining and steel shell; the lining of the steel shell providing back up insulation for the tubular coil; an air gap between shell refractory and clearance space above the coil is provided to allow for unrestricted thermal expansion of the helical coil; the helical coil which has one or more bottom inlets and top outlets; a top closure plate having an opening providing access to a refractory lined collector with rectangular cross-section and top and bottom sections separated by a horizontal steel plate; a continuous chain grate stoker located at the bottom of the radiant section containing the helical coil, and an orifice between the outlet of the stoker and the inlet of the heater radiant section sized to provide for a flue gas velocity of 250 feet per second; a vertical feed hopper at one end of the stoker providing a continuous flow of coarse coal having an average particle size measuring ½×⅜ inches and a minimum of minus 200 mesh coal fines, to the top of a moving grate at one end of the stoker and, after combustion, discharging essentially coal free ash at the opposite end thru a water sealed nozzle; burners located above the coal level at the inlet end of the grate provide initial ignition of the feed coal and multiple ports located between the top and bottom of the grates, along the length of the grates, provide pressurized air for combustion of the coal; a multiplicity of water cooled tubes, manifolded at inlets and outlets, imbedded in the refractory lining of the side walls, end walls, and top and bottom of the stoker enclosure; transfer lines from the inlet and outlet manifolds connected to an overhead steam drum separating the steam and water phases; refractory lined centrifugal solids—flue gas separators accepting solids laden flue gas from the lower section of the flue gas collector, located at the top of the heater radiant section, by means of refractory lined ducts, the inlets of which penetrate the walls of the lower flue gas collector and the outlets of which attach to the separator inlets; separator outlets connecting to the inlets of a second set of refractory lined ducts which transport essentially solids free flue gas to the duct outlets which penetrate the upper section of the section of the flue gas collector, the top of the flue gas collector discharging flue gas to an overhead up flow convection section.

* * * * *